US005187889A

United States Patent [19]

Kraselsky et al.

[11] Patent Number: 5,187,889

[45] Date of Patent: Feb. 23, 1993

[54] SCENIC DISPLAY ITEM

[76] Inventors: Louis J. Kraselsky, 4785 Velasquez, Pensacola, Fla. 32504; Kathryn L. Massel, 34 Randall Ave., Stamford, Conn. 06903

[21] Appl. No.: 794,699

[22] Filed: Nov. 20, 1991

Related U.S. Application Data

[63] Continuation of Ser. No. 463,342, Jan. 10, 1990, abandoned.

[51] Int. Cl.[5] ..... G09F 19/00

[52] U.S. Cl. ..... 40/407; 40/410; 472/137

[58] Field of Search ..... 40/407–410; 472/57, 137

[56] References Cited

U.S. PATENT DOCUMENTS

| | | | |
|---|---|---|---|
| D. 149,117 | 3/1948 | Funfrock . | |
| D. 257,266 | 10/1980 | Curry et al. . | |
| 736,751 | 8/1903 | Lobmiller . | |
| 2,361,423 | 10/1944 | Snyder | 40/410 |
| 3,692,382 | 9/1972 | Cloutier | 40/409 X |
| 3,816,224 | 6/1974 | Smart et al. . | |
| 4,221,078 | 9/1980 | Latham et al. . | |
| 4,521,982 | 6/1985 | Altuchow . | |
| 4,686,784 | 8/1987 | Smithies | 40/407 X |

OTHER PUBLICATIONS

Bacrofts Gift Guide, "Let It Snow" Paperweight, p. 49 (1957).

"Magic Desert Terrarium".

IEEE Spectrum, "Maintenance-free world", Jan. 1987, p. 77.

*Primary Examiner*—Richard E. Chilcot, Jr.

*Attorney, Agent, or Firm*—Venable, Baetjer, Howard & Civiletti

[57] ABSTRACT

A novelty display item comprises a transparent, sealed container loosely holding a solid flowable material and least one solid object, which together form a decorative scene. A new decorative scene is created by shaking, rolling or otherwise moving the item so that the flowable material and solid object within are displaced to new positions.

9 Claims, 2 Drawing Sheets

SCENIC DISPLAY ITEM

This application is a continuation of application Ser. No. 463,342, filed Jan. 10, 1990 now abandoned.

BACKGROUND OF THE INVENTION

The present invention relates to novelty articles and, in particular, to a novelty display item having a sealed, transparent container partially filled with solid, flowable material and at least one solid object. Together these elements form a scenic display. When the item is shaken, the flowable material and the solid objects therein move, thereby creating a different scenic display.

In the past, novelty viewers have been provided wherein a multiplicity of particles are carried in a liquid contained in a partially transparent container. Fixed within the container is either a scenic structure mounted to the base of the container or a graphic backdrop attached to a rear wall of the enclosure. Accordingly, when the container is shaken, the particles within disperse and momentarily become suspended in the liquid so as to augment the scenic structure or graphic backdrop. Oftentimes the particles represent snow while the scenic structure or graphic backdrop depicts a winter scene. The suspended particles eventually settle to the base of the container thereby returning the scenic view within the container to its original appearance.

In another novelty viewer, several liquids having different densities surround a simulated scene fixedly mounted within a transparent container. Each liquid, has a correspondingly different color. Accordingly, when at rest, the liquids establish strata of differently colored layers. When the container is shaken, the different liquids intermix but eventually settle, returning to the original layered configuration, once the shaking has stopped.

In still another novelty display item, a substantially spherical, transparent container encloses a fresh floral arrangement and a quantity of water for preserving the arrangement. The floral arrangement is mounted to the base of the container. A new arrangement is displayed within the container by removing the base of the container and replacing the mounted flowers with fresh flowers. The water within the container can also be replaced.

SUMMARY OF THE INVENTION

The present invention provides a novelty item comprising a transparent container having a single opening. A flowable solid material and at least one solid object, which together create a decorative scene, are loosely disposed in the container. A cap attached to the container sealingly covers the opening, thus preventing removal or spillage of the flowable solid material and the solid object from the container. Movement of the container causes a corresponding movement of the flowable solid material and the solid object such that different decorative scenes within the container are produced.

In a preferred embodiment of the invention, the container is made of glass and has a substantially spherical shape. In addition, the flowable solid material is sand (for example, beach sand from an ocean or lake beach), and the solid object comprises one or a plurality of sea shells.

In one of three particularly preferred embodiments, the cap comprises a transparent, beveled plate adhered to the container along a flat edge surrounding the opening. In a second embodiment, the cap comprises a flat plate having a mirrored surface. The flat plate is adhered to the container similarly to the beveled plate, and the mirrored surface faces outwardly. Lastly, the cap may comprise a relatively resilient plug, removably inserted into the opening of the container.

DETAILED DESCRIPTION OF THE PREFERRED EMBODIMENTS

The present invention relates to a novelty display item which, in response to movement, displays a variety of decorative scenes. The scenes are randomly generated such that each successive scene is different from the previous one. In accordance with the invention, a sealed, transparent body loosely holds a solid, flowable material and at least one solid object, which together form a decorative scene. The decorative scene is varied by shaking, rolling or otherwise moving the entire item. When the movement stops, the flowable material and solid object come to rest, forming a new scene.

Figure 1:
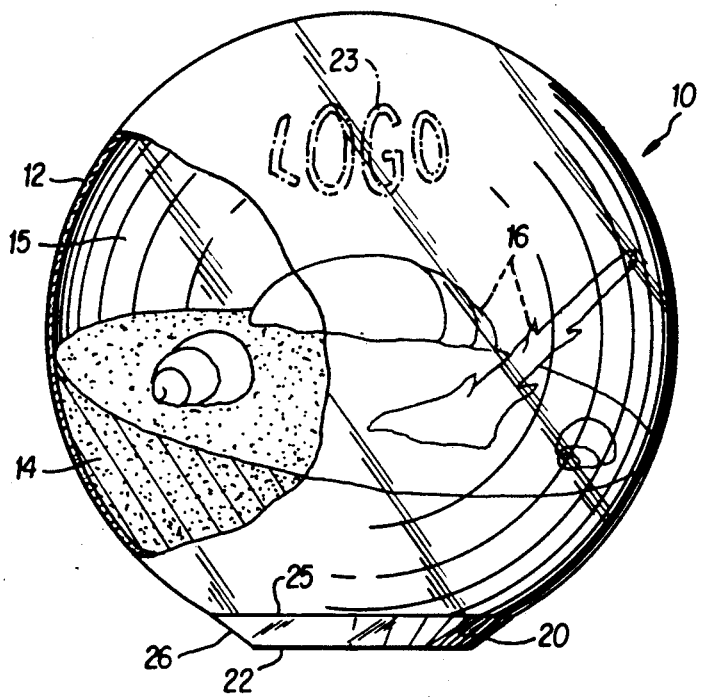
FIG. 1 is a front elevational view, partially broken away, of a novelty item in accordance with a preferred embodiment of the present invention.

FIG. 1 illustrates a novelty display item 10 according to a preferred embodiment of the invention. A transparent container 12 having a substantially spherical shape encloses a quantity of sand 14 and several sea shells 16. The sand 14 and sea shells 16 give the impression of a beach or shore scene within the container 12.

The container 12 is preferably made in one piece of transparent glass, plastic or a plastic-like material. It is preferably clear and colorless, but may be made slightly translucent and/or provided with a tint or color if desired. Preferably, the container is made of transparent colorless glass and is blown into a spherical shape in a known manner. The exact amount of sand 14 and number of sea shells 16 is not critical and will depend upon what is needed to create a desired scene. Enough empty space 15 devoid of liquid, however, should be left in the container to provide sufficient room for the sand 14 and sea shells 16 to move.

Figure 2:
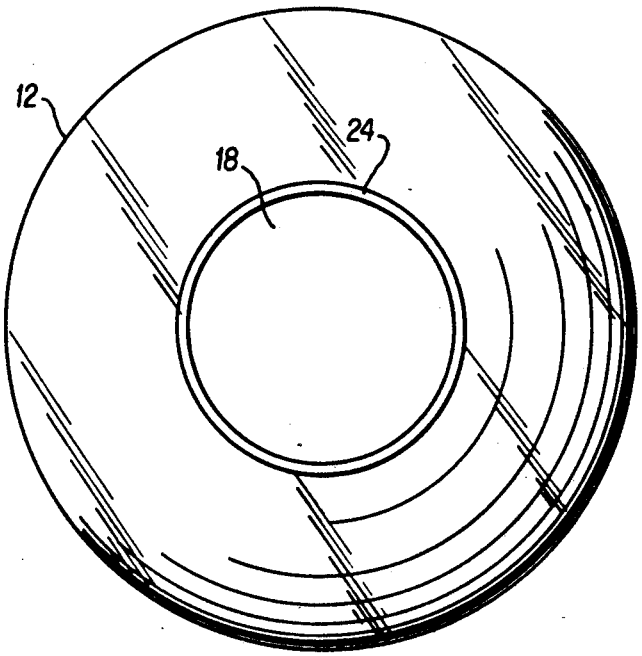
FIG. 2 is a bottom view of a container suitable for use in the embodiments of FIGS. 1, 3 and 4.

The sand 14 and sea shells 16 are inserted into the container 12 through an opening 18 at the bottom of the container (shown in FIG. 2). A cap 20 seals the opening 18 and, in addition to preventing spillage of the sand 14 and sea shells 16 from the container 12, functions as a stand for the novelty item 10. Preferably, the cap 20 is fixedly attached to the container 12 such that the sand 14 and sea shells 16 cannot be removed, thereby by providing a sealed environment than cannot be altered. The cap may be removable; however, it should at least maintain a sufficient seal so that the sand 14 and sea shells 16 do not spill when the item 10 is shaken or rolled. Three contemplated variations of the cap 20 are discussed further below in reference to FIGS. 3-5. Each variation of the cap 20, however, has a flat surface 22 on which the novelty item 10 rests. As illustrated in FIG. 1, the novelty item 10 may have a logo 23 or other advertising, message or indicia etched thereon.

Referring to FIG. 2, the opening 18 preferably has a circular configuration as shown. It need only be large enough to allow for the passage of sand 14 and sea shells 16. Preferably, the opening 18 is also small enough so that when the item 10 sets on a surface, it has the appearance of a complete sphere. FIG. 2 also illustrates a peripheral flat edge 24 which surrounds the opening 18. The flat edge 24 provides a surface on which one of the caps 20, described in reference to FIGS. 3 and 4, can be affixed.

Figure 3:
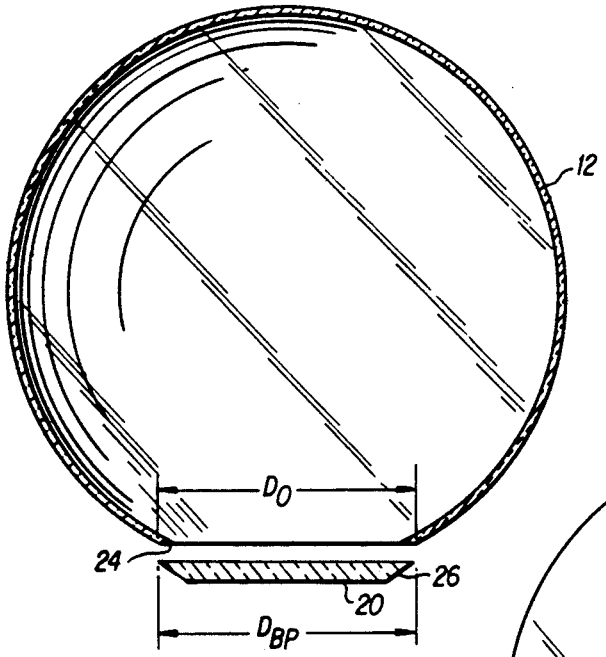
FIG. 3 is cross-sectional view of the container and cap used in the embodiment of FIG. 1.

FIG. 3 illustrates a preferred arrangement for capping the opening 18 of the container 12. In this embodiment, which corresponds to that shown in FIGS. 1 and 2, the cap 20 is a transparent, beveled glass plate having substantially the same circular configuration as the opening 18. In particular, the outer diameter $D_{BP}$ of the beveled plate 20 is substantially equal to the outer diameter $D_o$ of the opening 18. The beveled plate 20 is attached to the container 12 along the flat edge 24 by ultraviolet-curable glue, epoxy, or other adhesive which dries relatively clear and provides a good seal. The beveled plate 20 is shaped and dimensioned so that its beveled portion 26 appears to substantially continue the spherical contour of the container 12. Accordingly, the seam 25 (FIG. 1) between the cap 20 and container 12 is not readily noticeable.

Figure 4:
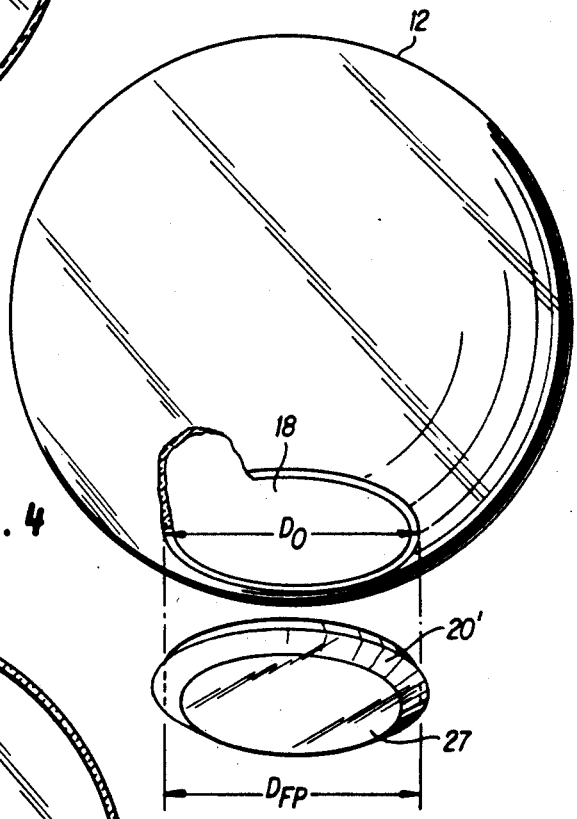
FIG. 4 is a perspective view of a container, partially broken away, and a cap according to a second embodiment of the invention.

FIG. 4 illustrates a second type of cap 20' which may be used to cover and seal the opening 18 of a container 12 having a flat edge 24. The cap 20' is a flat circular metal plate with a diameter $D_{FP}$ approximately equal to the outer diameter $D_o$ of the opening 18. One side of the flat plate 20' is provided with a mirrored finish 27. The flat plate 20' is adhered to the container 12 so that the mirrored finish 27 faces outwardly. Like the beveled plate 20 of FIG. 3, the flat plate 20' is affixed to the container 12 by an appropriate adhesive.

Figure 5:
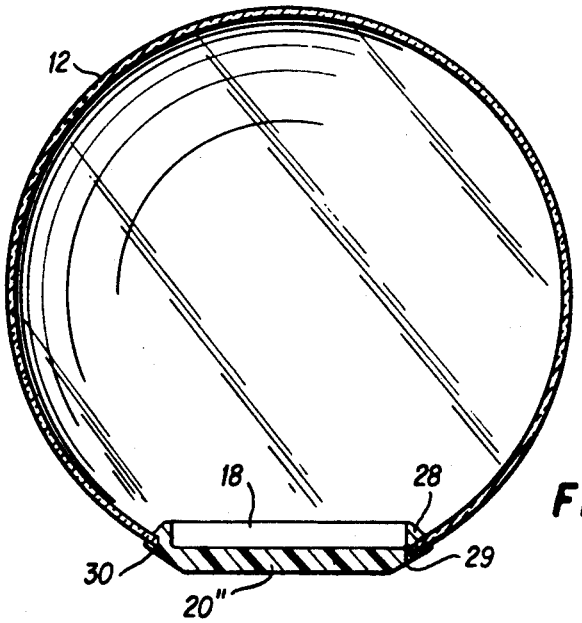
FIG. 5 is a cross-sectional view of a container and a cap according to a third embodiment of the invention.

In a third embodiment of the invention, illustrated in FIG. 5, a cap in the form of a plug 20" is inserted into the opening 18 of the transparent container 12 in order to seal the opening 18. The opening 18 in this embodiment, however, is bordered by a substantially vertical cut edge 29. A flange 28 on the plug 20" grips the vertical edge 29 of the container 12. In addition, the plug 20" has a lip 30 that lies flat along the exterior of the container 12 near the opening 18 in order to provide a smooth contour between the plug 20" and the container 12. The plug 20" is preferably made from a resilient material, such as rubber, so that it can be easily manipulated into position. It is fixedly attached to the container 12 by an appropriate adhesive to prevent its removal and spillage of the material in the container 12.

In use, the novelty item 10 is shaken, rolled or otherwise moved to create different scenic views within the container 12. Each movement of the novelty item 10 produces a new scene. Other flowable material could be substituted for the sand 14, as well as other solid objects for the sea shells 16, to create different types of scenes. Furthermore, the transparent container 12 need not be spherical, and can have a variety of different shapes.

Although the invention has been described in terms of what are at present believed to be its preferred embodiments, it will be apparent to those skilled in the art that various changes can be made without departing from the scope of the invention. All such changes are intended to be embraced within the scope of the appended claims.

What is claimed is:

1. A novelty item comprising:

a transparent container, said container having a substantially spherical shape that is truncated at one end to define a substantially circular opening;

flowable solid material loosely held in said container, said flowable solid material comprising a plurality of individual solid particles;

at least one sea shell loosely held in said container, wherein said flowable solid material and said at least one sea shell together create a decorative scene; and a cap attached to said container such that said cap sealingly covers said opening, said cap having a substantially flat outer surface and a bevelled side surface that substantially continues the spherical contour of said container, said cap providing a stand for supporting said container;

whereby movement of the container causes corresponding movement of said flowable solid material and said at least one sea shell such that the orientation of the material and the sea shell is changed, thereby producing a different decorative scene within the container.

2. The novelty item of claim 1, wherein said cap is fixedly attached to said container.

3. The novelty item of claim 1, wherein said container is made of glass.

4. The novelty item of claim 1, wherein said flowable solid material comprises sand.

5. The novelty item of claim 1, wherein said cap is transparent.

6. The novelty item of claim 1, wherein said flat surface of said cap is provided with a mirrored finish.

7. The novelty item of claim 1, wherein said cap is a relatively resilient plug, insertable in said opening to seal said opening.

8. The novelty item of claim 1, wherein said flowable solid material and said at least one sea shell partially fill the container leaving an open space within the container for the flowable solid material and said at least one sea shell to move through when the container is moved.

9. The novelty item of claim 1, wherein said container is devoid of liquid.

* * * * *